US010195113B2

(12) United States Patent
Hunter et al.

(10) Patent No.: US 10,195,113 B2
(45) Date of Patent: Feb. 5, 2019

(54) ADAPTOR FOR REMOVAL OF FLUID FROM VIAL USING A NEEDLE-FREE SYRINGE

(71) Applicant: Massachusetts Institute of Technology, Cambridge, MA (US)

(72) Inventors: Ian W. Hunter, Lincoln, MA (US); Ashin P. Modak, Cupertino, CA (US); Nora Catherine Hogan, Boston, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 703 days.

(21) Appl. No.: 14/699,846

(22) Filed: Apr. 29, 2015

(65) Prior Publication Data

US 2015/0313798 A1 Nov. 5, 2015

Related U.S. Application Data

(60) Provisional application No. 61/986,679, filed on Apr. 30, 2014.

(51) Int. Cl.
*A61J 1/20* (2006.01)
*A61J 1/14* (2006.01)

(52) U.S. Cl.
CPC ..... *A61J 1/2044* (2015.05); *A61J 1/14* (2013.01); *A61J 1/201* (2015.05); *A61J 1/2055* (2015.05); *A61J 1/2096* (2013.01); *A61J 1/1406* (2013.01)

(58) Field of Classification Search
CPC .. A61J 1/04; A61J 1/1406; A61J 1/201; A61J 1/2044; A61J 1/2055; A61J 1/2089; A61J 1/20961
See application file for complete search history.

(56) References Cited

U.S. PATENT DOCUMENTS 5,599,302 A 2/1997 Lilley et al.
5,704,911 A 1/1998 Parsons
(Continued)

FOREIGN PATENT DOCUMENTS

JP 2004 209278 A 7/2004
JP 2009 172099 A 8/2009
(Continued)

OTHER PUBLICATIONS

International Preliminary Report on Patentability, issued in International Application No. PCT/US2015/028263, entitled "Adaptor for Removal of Fluid From Vial Using a Needle-Free Syringe," dated Nov. 10, 2016.
(Continued)

*Primary Examiner* — Benjamin Klein
(74) *Attorney, Agent, or Firm* — Hamilton, Brook, Smith & Reynolds, P.C.

(57) ABSTRACT

A needle-free adaptor for removing liquid from a vial comprises a cannula adapted to piece a septum of a vial, a plurality of legs surrounding the cannula to secure the adaptor to the vial when the cannula has pieced the septum, an elastomeric membrane having a normally closed pinhole orifice, and a conforming surface having an orifice connected to the cannula. The elastomeric membrane has a stable convex shape and is adapted to receive a nozzle of a needle-free device. Pressed against the elastomeric membrane, the nozzle deflects the elastomeric membrane from the convex shape to an unstable or pseudo-stable inverted position against the conforming surface. Buckling of the elastomeric membrane opens the pinhole orifice and enables fluid communication between the vial and the nozzle by interfacing the pinhole orifice with the orifice on the conforming surface.

24 Claims, 9 Drawing Sheets

(56) References Cited

U.S. PATENT DOCUMENTS

| | | | | |
|---|---|---|---|---|
| 7,833,189 | B2 | 11/2010 | Hunter et al. | |
| 2003/0153895 | A1 | 8/2003 | Leinsing | |
| 2013/0066293 | A1* | 3/2013 | Garfield | A61J 1/10 604/408 |
| 2015/0265499 | A1* | 9/2015 | Takeuchi | A61M 5/162 604/414 |

FOREIGN PATENT DOCUMENTS

| | | | | |
|---|---|---|---|---|
| JP | 2009172099 | A | * | 8/2009 |
| WO | WO 2013/088970 | A1 | | 6/2013 |
| WO | WO 2014/061661 | A1 | | 4/2014 |

OTHER PUBLICATIONS

Notification of Transmittal of The International Search Report and The Written Opinion of the International Searching Authority, or the Declaration for International Application No. PCT/US2015/028263 "Adaptor for Removal of Fluid From Vial Using a Needle-Free Syringe", dated Aug. 13, 2015.

* cited by examiner

ADAPTOR FOR REMOVAL OF FLUID FROM VIAL USING A NEEDLE-FREE SYRINGE

RELATED APPLICATION

This application claims the benefit of U.S. Provisional Application No. 61/986,679, filed on Apr. 30, 2014. The entire teachings of the above application are incorporated herein by reference.

BACKGROUND OF THE INVENTION

Injection of medication often requires that a liquid drug be drawn from a vial or ampoule containing the medication into a syringe or cartridge prior to delivery of the liquid via a needle to the target. The needle serves as both the element that punctures the medication vial to permit reconstitution and withdrawal of drug and the element that punctures the target tissue for delivery. FIGS. 1A-E are schematics of a typical liquid drug extraction method using a needle and syringe.

As shown in FIGS. 1A-E, the common method used to fill a syringe involves inserting the syringe needle into the vial through a self-sealing septum (FIG. 1A), inverting the vial (FIG. 1B), and pushing a volume of air equivalent to the desired volume of drug into the vial (FIG. 1C). When the syringe piston is drawn back, as illustrated in FIG. 1D, the syringe is filled with liquid from the vial, except a small volume of air remaining in the syringe because of dead space in the needle itself is then removed as shown in FIG. 1E. While this procedure is common practice for filling a syringe, modern needle-free injection devices do not use needles. As such, there is no needle to pierce the rubber septum sealing the vial and there exists a need for an adaptor that enables removal of liquid from a vial using a needle-free syringe.

SUMMARY OF THE INVENTION

A primary advantage of embodiments of the present invention is that they can remove any requirement for an exposed needle at any stage in the cycle, the importance of which is the elimination of needle stick injuries and the associated consequences. The costs of a single high-risk needle stick injury and lifetime treatment of a person found to be seropositive are substantial.

The present adaptor can be used in any situation requiring liquid withdrawal from a fluid-filled container or vial using a needle-free device. It can also be used to transfer liquid from a needle-free ampoule to a vial containing for example a drug that needs to be reconstituted, where just in time mixing of two or more drugs is required prior to delivery.

An example embodiment of the invention is a needle-free adaptor for removing liquid or a substance from a vial, the needle-free adaptor comprises a cannula having a distal end adapted to pierce a septum of a vial, a plurality of legs surrounding the cannula, the plurality of legs configured to secure the adaptor to the vial when the cannula has pierced the septum, a membrane comprising a normally closed orifice, the membrane having a stable convex position and an inverted position, the membrane adapted to receive a nozzle of an ampoule of a needle-free device and buckle from the convex position to the inverted position, and a conforming surface adapted to receive the membrane when buckled by the nozzle, the conforming surfacing including an orifice connected to the cannula. When the membrane deflects, the normally closed orifice opens and interfaces with the orifice on the conforming surface. Buckling of the membrane enables fluid communication between the vial and the nozzle. The normally closed orifice can be a pinhole or slit orifice. In some embodiments, the membrane is an elastomeric membrane.

The needle-free adaptor can include a protective cover surrounding the plurality of legs, the protective cover extending a length along the plurality of legs and beyond the distal end of the cannula. The protective cover may include a window enabling visual inspection of a vial secured by the plurality of legs. The needle-free adaptor can also include a removable cap covering the elastomeric membrane and a sleeve adjacent to an external surface of the elastomeric membrane to protect the external surface and prevent accidental inversion or buckling of the elastomeric membrane. The sleeve can also aid alignment of the ampoule to the normally closed orifice and can include locking features to secure the ampoule to the adaptor when in contact with the elastomeric membrane.

The elastomeric membrane can be made from polyurethane, halobutyl or ethylene propylene diene monomer (EPDM) and can have a hemispherical shape in the stable convex position.

In some embodiments, buckling of the elastomeric membrane requires a buckling pressure and the buckling position is maintained by a holding pressure, the holding pressure being less than the buckling pressure. The elastomeric membrane can be a bi-stable membrane having a stable convex position and pseudo-stable inverted position, the pseudo-stable inverted position returns to the stable convex position after removal of the ampoule. The elastomeric membrane can be a mono-stable membrane having a stable convex position and an unstable inverted position, the unstable inverted position returns to the stable convex position immediately after removal of the ampoule.

Another example embodiment of the invention is a method of drawing a substance from a vial without a needle. The method comprises piercing a septum of a vial with a cannula of an adaptor, securing the adaptor to the vial with a plurality of legs, deflecting an membrane of the adaptor from a stable convex position to an inverted position with a nozzle of a needle-free device, the deflecting opening an orifice in the membrane, pressing the deflected membrane against a conforming surface of the adaptor, the conforming surface having an orifice in fluid communication with the cannula, the pressing creating an interface between the opened orifice in the membrane and the orifice of the conforming surface, drawing a substance from the vial, through the orifice of the conforming surface, the opened orifice in the membrane, and the nozzle, and removing the nozzle from the membrane, the membrane returning to the stable convex position and closing the pinhole orifice. In some embodiments, the membrane is an elastomeric membrane.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

The teachings of all patents, published applications and references cited herein are incorporated by reference in their entirety.

While jet injection technologies such as those discussed for example in U.S. Pat. No. 7,833,189, U.S. Pat. No. 5,704,911, and U.S. Pat. No. 5,599,302 provide a needle-free method for delivery of a drug, there still exists the need to fill an ampoule with a substance or, in some cases, reconstitute a substance and fill the ampoule with the reconstituted substance prior to injection. The present adaptor permits filling of ampoules or cartridges with liquid (e.g., a liquid drug) in the absence of an exposed needle. Such a device can be reusable and used to fill multiple ampoules for needle-free drug delivery. For example, liquid may be drawn from a vial into an empty ampoule or an ampoule containing a powder, or liquid from an ampoule may be forced into a vial containing a powder to reconstitute a solution, which is then drawn into the ampoule.

Figure 1A:
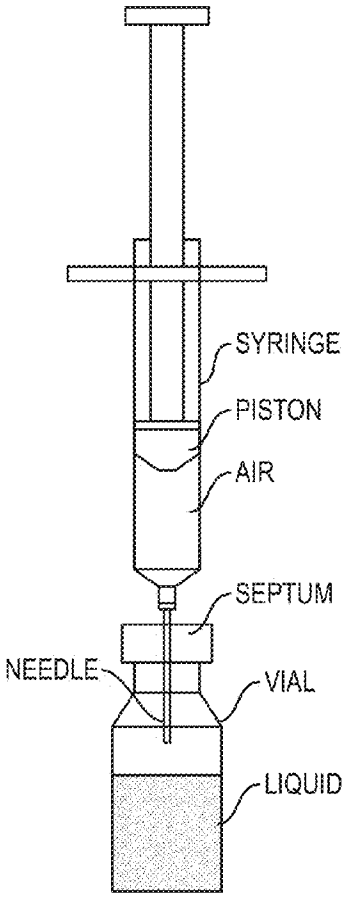
FIG. 1A (PRIOR ART)
FIGS. 1A-E are schematics of prior art drug extraction technique using a needle and syringe.
Figure 1B:
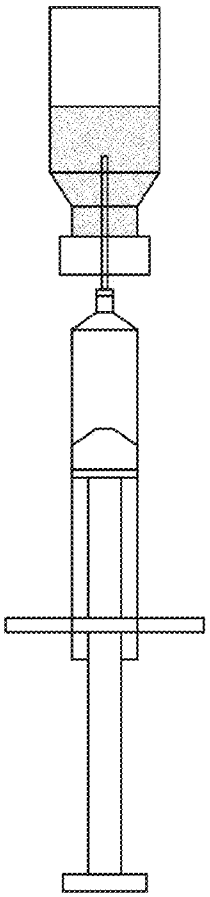
FIG. 1B (PRIOR ART)
Figure 1C:
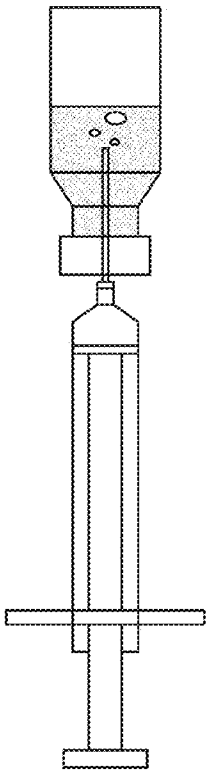
FIG. 1C (PRIOR ART)
Figure 1D:
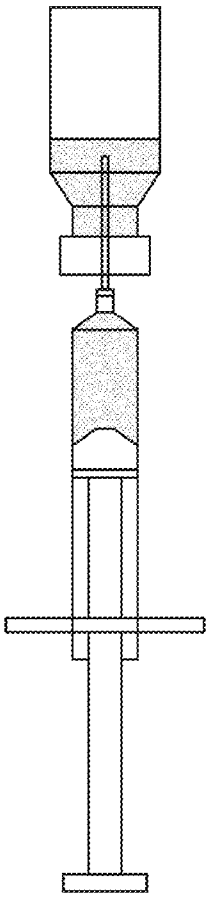
FIG. 1D (PRIOR ART)
Figure 1E:
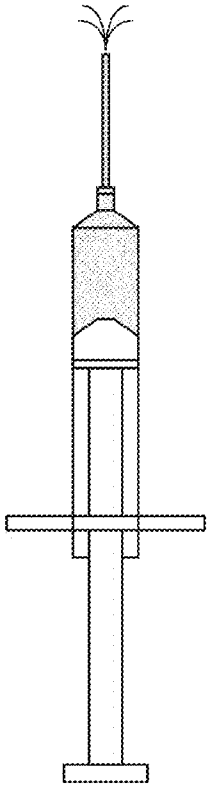
FIG. 1E (PRIOR ART)
Figure 2B:
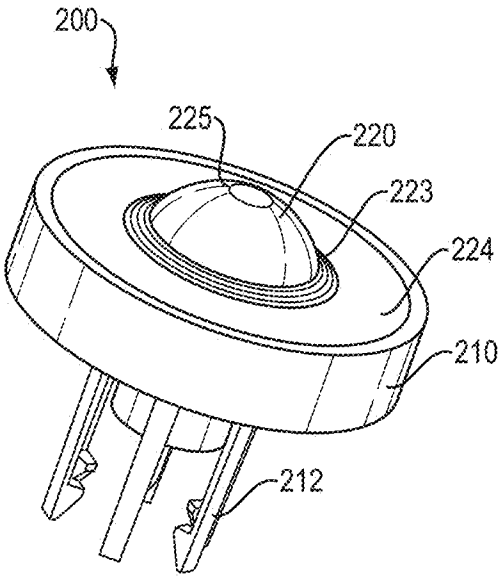
FIGS. 2A-B are schematic views of a needle-free adaptor.
Figure 2A:
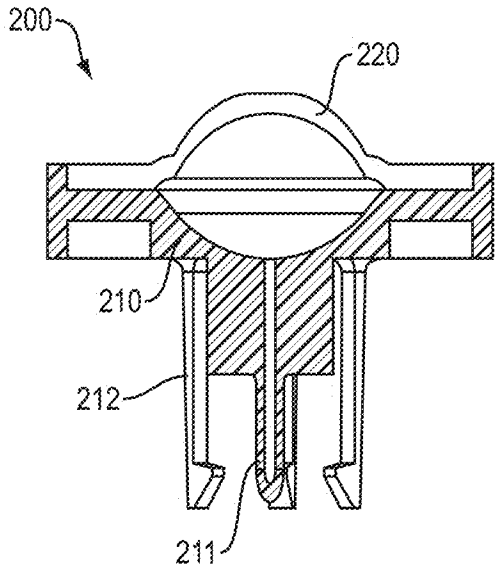

FIGS. 2A-B are views of a needle-free adaptor. FIG. 2A is a cross sectional view of the body 210 a needle-free vial adaptor 200. The needle-free vial adaptor 200 interfaces between a needle-free nozzle and an existing prefilled vial (FIGS. 4 and 7). The vial may be, for example, any container sealed by a septum. The body 210 of the adaptor 200 is configured to be in direct contact with a septum in a vial. The body 210 includes a plastic cannula 211 designed to pierce the septum and flexible legs 212 to create a snap fit around a metallic crimp of the vial. Because the cannula 212 is made of plastic and protrudes from the body 210 less than the flexible legs 212 used to couple the adaptor 200 with the vial or ampoule, the risk of accidental needle stick injuries to the user is greatly minimized. The adaptor 200 includes an elastomeric membrane, shown as a hemispherical shaped membrane 220, disposed on the end of the body 210 opposite the cannula 211 to interface with a needle-free nozzle and sealingly connect the nozzle to the cannula. The elastomeric membrane functions to seal the vial when the elastomeric membrane is in a nominal, i.e., convex, position.

FIG. 2B shows a profile view of the adaptor 200 having a hemispherical shaped membrane 220. The hemispherical shaped membrane 220 includes a center hemispherical region 225, a peripheral region 224 attached to the body 210 of the adaptor 200, and a thin ridge 223 connecting the hemispherical region 225 to the peripheral region 224. The center hemispherical region 225 of the hemispherical shaped membrane 220 is adapted to deflect inwards, towards the body 210 of the adaptor, and sealingly connect a nozzle of a needle-free device to the cannula 211. The thin ridge 223 sets the boundary conditions for movement of the hemispherical region 225. When buckled, the hemispherical shaped membrane 220 enables a substance to be drawn out of the vial, through the cannula 211, and into the nozzle. The hemispherical shaped membrane 220 can be molded out of rubber, and the rubber can be any of those commonly used in pharmaceutical enclosures, for example, a halobutyl or ethylene propylene diene monomer (EPDM).

Figure 3:
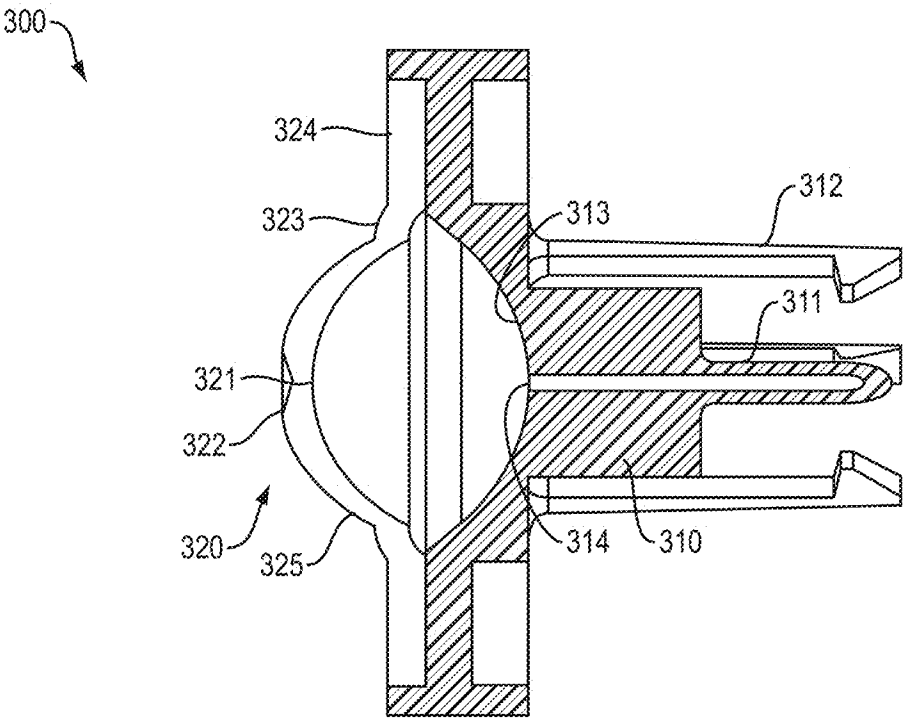
FIG. 3 is a schematic of a needle-free adaptor.

FIG. 3 is a schematic of a needle-free adaptor. FIG. 3 shows a cross section of the needle-free adaptor 300. The needle-free adaptor 300 includes a body 310 and a hemispherical membrane 320 covering a distal end of the body 310. The body 310 of the adaptor 300 includes a cannula 311, a plurality of legs 312, a conforming surface 313, and an orifice 314. The cannula 311 is able to pierce the rubber septum of a vial while being held in place by the plurality of legs 312 grasping the metallic crimp of the vial (shown in FIGS. 6 and 7). The plurality of legs 312 can be encased in a plastic sleeve incorporated into the design of the adaptor (shown in FIG. 5). The hemispherical membrane 320 includes a pinhole orifice 321 (or zero-diameter hole) through its center, the pinhole orifice 321 includes a distal conical taper or dimple 322 configured to align a nozzle orifice when the nozzle is seated against the pinhole orifice 321.

In operation, the hemispherical membrane 320 of FIG. 3 is nominally in a stable convex shape or position, as shown, prior to interfacing with a nozzle of an ampoule of a needle-free device. In the stable convex position, the pinhole orifice 321 is closed and forms a seal across the hemispherical membrane 320. When a nozzle of an ampoule is positioned against the dimple 322 and pushed into the adaptor 300, the hemispherical member 320 flexes inward until it buckles and presses against the conforming surface 313 formed in the body 310 of the adaptor. The conforming surface 313 enables the nozzle of the ampoule to be pressed against the orifice 314 for delivery of liquid to or removal of liquid from a vial. When inverted, the pinhole orifice 321 on the inner surface of the hemispherical membrane 320 is opened and interfaces with the orifice 314 to allow liquid to be pulled through the cannula 311, orifice 314, pinhole orifice 321, and nozzle of the needle-free ampoule or device seated in the dimple 322, thereby permitting substance to be drawn into the ampoule or a reservoir of the device. A liquid could just as easily be transferred in the opposite direction as, for example, to reconstitute a powdered drug. Because the hemispherical membrane 320 is made of an elastomer, a seal is created between the vial adaptor 300 and the ampoule to allow extraction of liquid from the vial. The adaptor 300 disclosed herein is scalable, i.e., it can be adapted for use on vials having variable stopper diameters.

The advantage of the hemispherical membrane 320 is that once the initial buckling force is applied to the hemispherical membrane 320 in a stable convex shape, the hemispherical membrane 320 deflects or inverts inward against the conforming surface 313 and little to no force is required for the membrane to stay in the buckled or inverted position. In this manner, the hemispherical membrane 320 exhibits either mono-bistability or pseudo-bistability. In a mono-bistable configuration, the hemispherical membrane 320 moves away from the conforming surface 313 (shown in FIG. 4B) immediately upon removal of the nozzle. In a pseudo-bistable configuration, the hemispherical membrane 320 exhibits a pseudo stable mode when inverted against the conforming surface 313 and returns the stable convex shape after a certain period, for example, a half second. To enable pseudo-bistability, a center hemispherical region 325 of the hemispherical membrane 320 is attached to a stationary region 324 of the hemispherical membrane 320 by a thin ridge 323. When depressed towards the conforming surface 313, the thin ridge 323 provides hinge movement at the outer edge of the center hemispherical region 325. The hinge movement of the thin ridge 323 approximates a free boundary between the center hemispherical region 325 and the stationary region 324 of the hemispherical membrane 320.

In an illustrative example of the adaptor 300 of FIG. 3, the body 310, including the cannula 311, legs 312, and conforming surface 313, are constructed from solid plastic such as a polycarbonate. The cannula 311 has an inner and outer diameter of 1.0 mm and 2.2 mm respectively. The membrane 320 includes a centered, tapered hole 321 having a widest diameter of 4.0 mm, when inverted. The region of the membrane 320 that flexes inward has an inner radius of curvature of 6.13 mm and a diameter and thickness of 18.8 mm and 2.0 mm respectively. The inner curvature of the conforming surface 313, which the membrane 320 will conform to when inverted, has a radius of curvature of 9.59 mm.

Figure 4B:
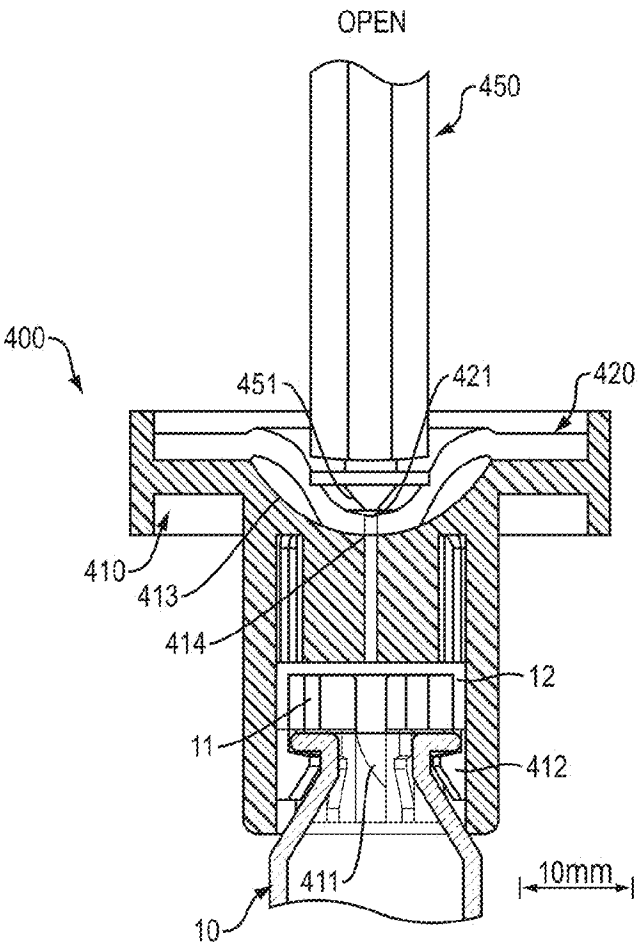
FIGS. 4A-B are schematics of the operation of the hemispherical membrane on the adaptor.
Figure 4A:
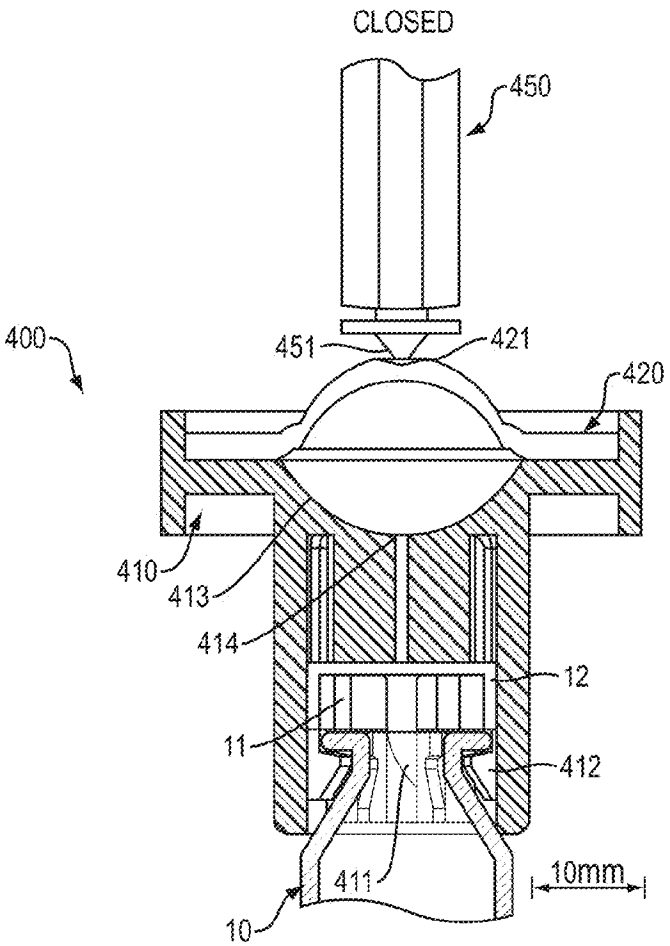

FIGS. 4A-B are schematics of the operation of the hemispherical membrane 420 on the adaptor 400. The pinhole orifice 421 in the hemispherical membrane 420 is effectively sealed when the hemispherical membrane 420 is in its stable convex position. The pinhole orifice 421 opens when the hemispherical membrane 420 is inverted to allow for flow of liquid between the nozzle 451 of the ampoule 450 and vial 10 while maintaining a seal with the nozzle 451.

FIG. 4A shows the adapter 400 attached to a vial 10, and an ampoule 450 and nozzle 451 of a needle-free device positioned to interface with a hemispherical membrane 420 on the adapter 400. The body 410 of the adapter 400 includes a cannula 411 and a plurality of legs 412. The vial 10 includes an open end sealed by a rubber septum 11 and a metallic cap 12 securing the rubber septum in the vial 10. The cannula 411 of the adapter 400 pierces the septum 11 of the vial 10 and the plurality of legs 412 secure the adapter 400 to the vial 10 by interfacing with the metallic cap 12. A hemispherical membrane 420, shown in a stable convex position, provides a seal over an orifice 414 in a conforming surface 413 in the body 410 of the adaptor 400 opposite the inner surface of the hemispherical membrane 420. The nozzle 451 of the ampoule 450 is positioned against a closed pinhole orifice 421 in the center of the membrane 420.

In FIG. 4B, the nozzle 451 of the ampoule 450 has depressed the hemispherical membrane 420 against the conforming surface 413 of the body 410 of the adapter 400. In this inverted position, the pinhole orifice 421, which is normally closed, is opened and pressed against the orifice 414 in the body 410 of the adapter 400 by the nozzle 451 of the ampoule 450. With the pinhole orifice 421 opened and pressed between the nozzle 451 and the orifice 414 in the body 410, the nozzle 451 has made a seal with the cannula 411, the distal end of which has pierced the septum of the vial 10 thereby providing an open channel for liquid to flow from the vial 10 and into the ampoule 450. Upon removal of the nozzle 451 from the hemispherical membrane 420, the hemispherical membrane 420 returns to the configuration shown in FIG. 4A.

Figure 5:
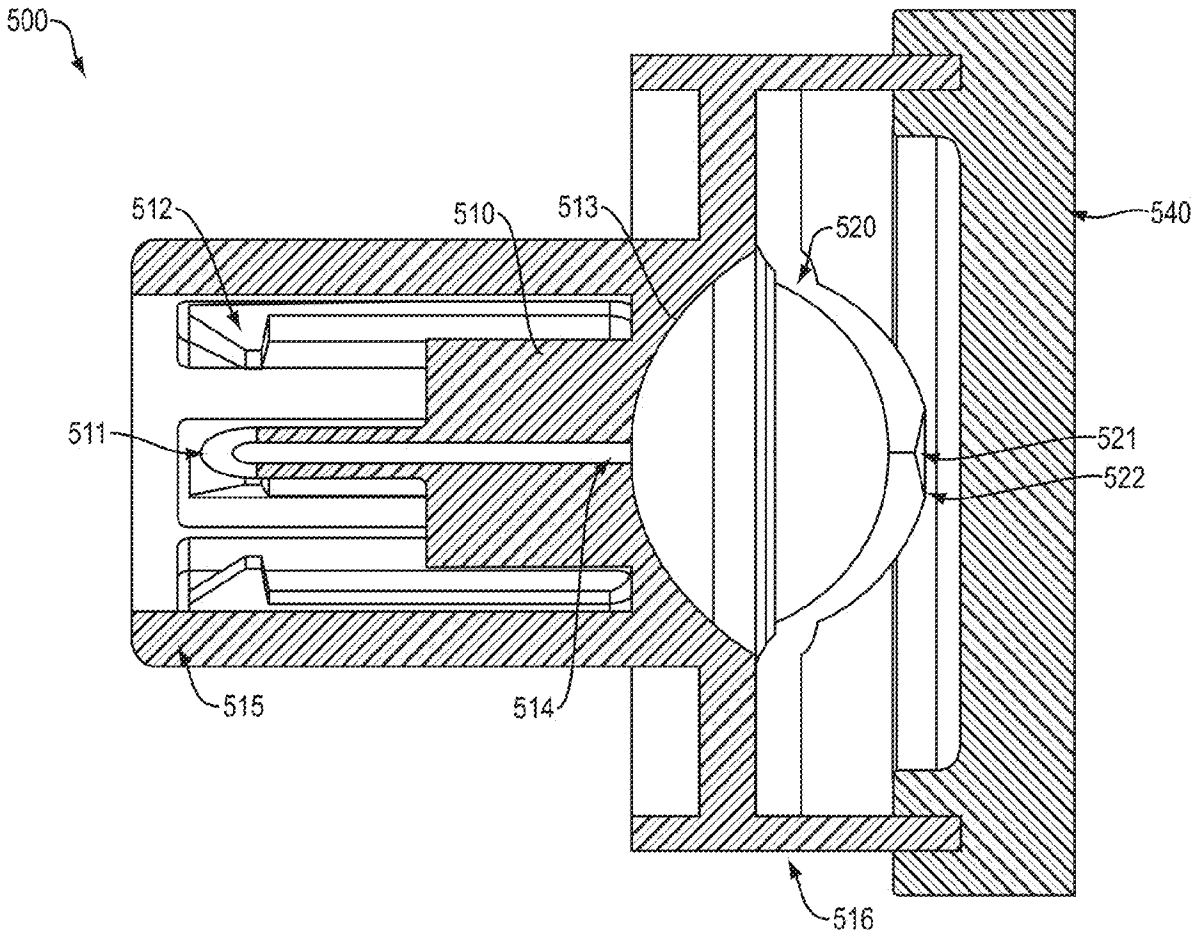
FIG. 5 is a schematic of the needle-free adaptor illustrated in FIG. 3 including a protective cover sleeve and cap.

FIG. 5 is a schematic of a needle-free adaptor 500, as illustrated in FIG. 3, including a protective cover sleeve 515 and protective cap 540. The adaptor 500 includes a hemispherical membrane 520 having a pinhole orifice 521 and aligning dimple 522. The body 510 of the adaptor 500 includes a cannula 511, snap-fit legs 512, and a conforming surface 513 with orifice 514 to receive the buckled hemispherical membrane 520. The protective cover sleeve 515 is positioned around the snap-fit legs 512 and extends beyond the length of the snap-fit legs 512 and the cannula 511 to protect the snap-fit legs 512 from damage and to prevent the user from accidentally touching the cannula 511. The exterior surface of the protective cover sleeve 515 can provide a stable surface to hold the adaptor 500 and thereby ensure contact between the adaptor 500 and nozzle (451 in FIGS. 4A-B) during filling. The protective cap 540 interfaces with a distal flange of the body 510 that surrounds hemispherical membrane 520. The protective cap 540 covers the entirety of the hemispherical membrane 520 and helps to maintain sterility and prevent accidental buckling of the hemispherical seal 420 while handling.

Figure 6:
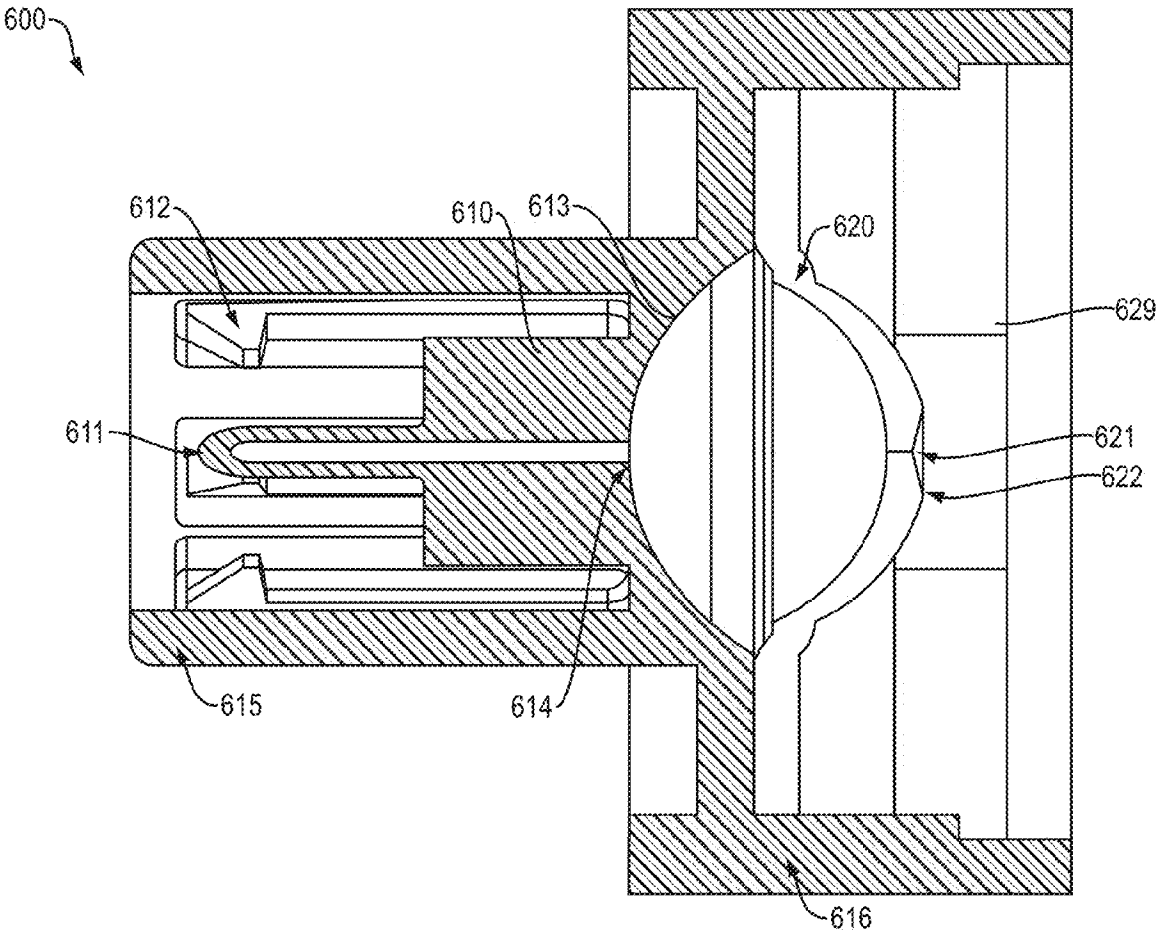
FIG. 6 is a schematic of the needle-free adaptor illustrated in FIG. 3 including a protective cover and a rubber sleeve to help hold an ampoule in place during the loading process.

FIG. 6 is a schematic of a needle-free adaptor 600, as illustrated in FIG. 5, including a rubber sleeve 629 to help hold an ampoule (450 in FIG. 4B) in place while in sealing contact with the hemispherical membrane 520. The adaptor 600 includes a rubber sleeve 629 distal to the protective cover sleeve 615 that serves to align a nozzle (451 in FIG. 4B) with the dimple 622 and pinhole orifice 621 on the hemispherical membrane 620 and can secure the ampoule (450 in FIG. 4B) in place during the loading process using friction if the inner surface of rubber sleeve 629 is undersized. The rubber sleeve 629 can prevent accidental inversion of the hemispherical membrane 620 while handling.

Figure 7D:
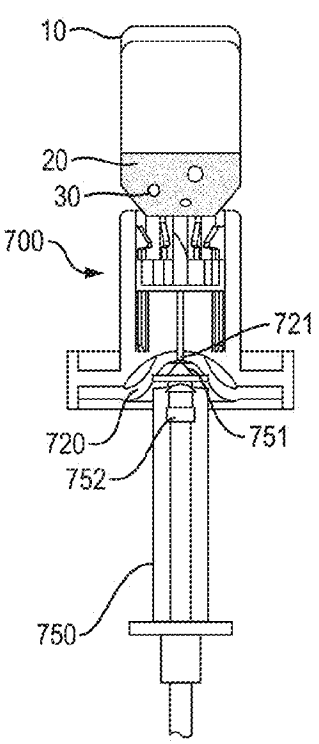
FIGS. 7A-H are schematics illustrating drug extraction using a needle-free adaptor.
Figure 7C:
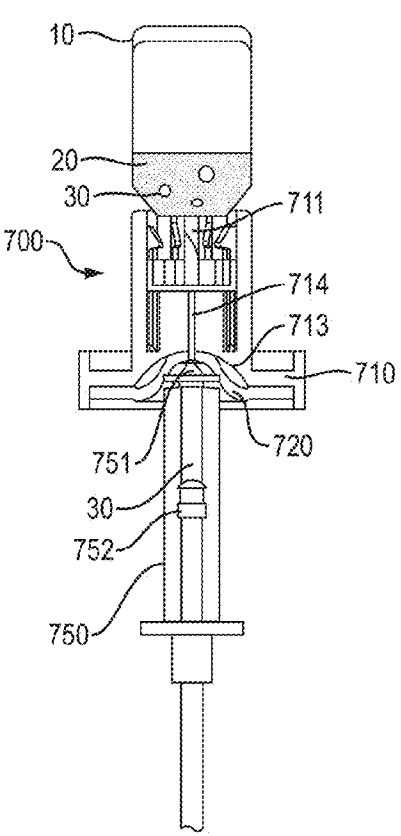
Figure 7B:
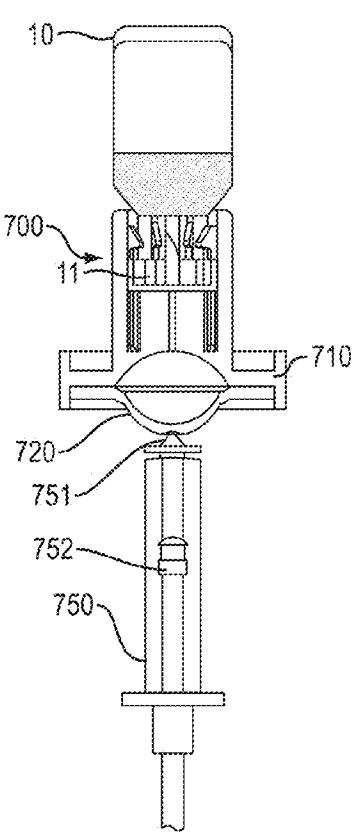
Figure 7A:
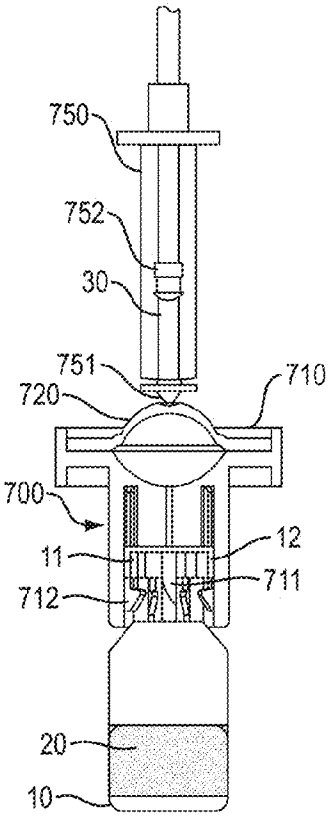

FIGS. 7A-H illustrate drug extraction using the needle-free adaptor illustrated in FIG. 5. The procedure for extracting liquid 20 from a vial 10 using the novel adaptor 700 is shown in FIGS. 7A-H. In FIG. 7A, the adaptor 700 has already been seated on the vial 10, and the cannula 711 in the body 710 of the adaptor 700 has already pierced the rubber septum 11 of the vial 10. The body 710 of the adaptor 700 is secured to the vial 10 by a plurality of snap-fit legs 712 interfacing with the metal crimp 12 securing the septum 11 in the vial 10. An ampoule 750 of a needle-free device is positioned to interface with the adaptor 700. The ampoule 750 includes a nozzle 751 at a distal end of the ampoule 750 and an internal plunger 752. The internal plunger 752 is withdrawn and the ampoule 750 is filled with air 30. The nozzle 751 of the ampoule 750 is positioned against a hemispherical membrane 720 on the adaptor 700; the hemispherical membrane 720 is in a stable convex position, as previously explained.

In FIG. 7B, the vial 10, adaptor 700, and ampoule 750 are inverted and the liquid 20 in the vial 10 reaches the cannula 711. In FIG. 7C, the nozzle 751 of the ampoule 750 deflects and buckles the hemispherical membrane 720 inwards against a conforming surface 713 on the body 710 of the adaptor 700 and expels air 30 into vial 10 through an orifice 714 and the cannula 711 in the body 710 of the adaptor 700. The buckling of the hemispherical membrane 720 opens a pinhole orifice 721 in the center of the hemispherical membrane 720 and interfaces the pinhole orifice 721 with the orifice 714 in the body 710. This interface enables fluid travel between the nozzle 751 and the vial 10.

Figures 7E, 7F, 7G, 7H:
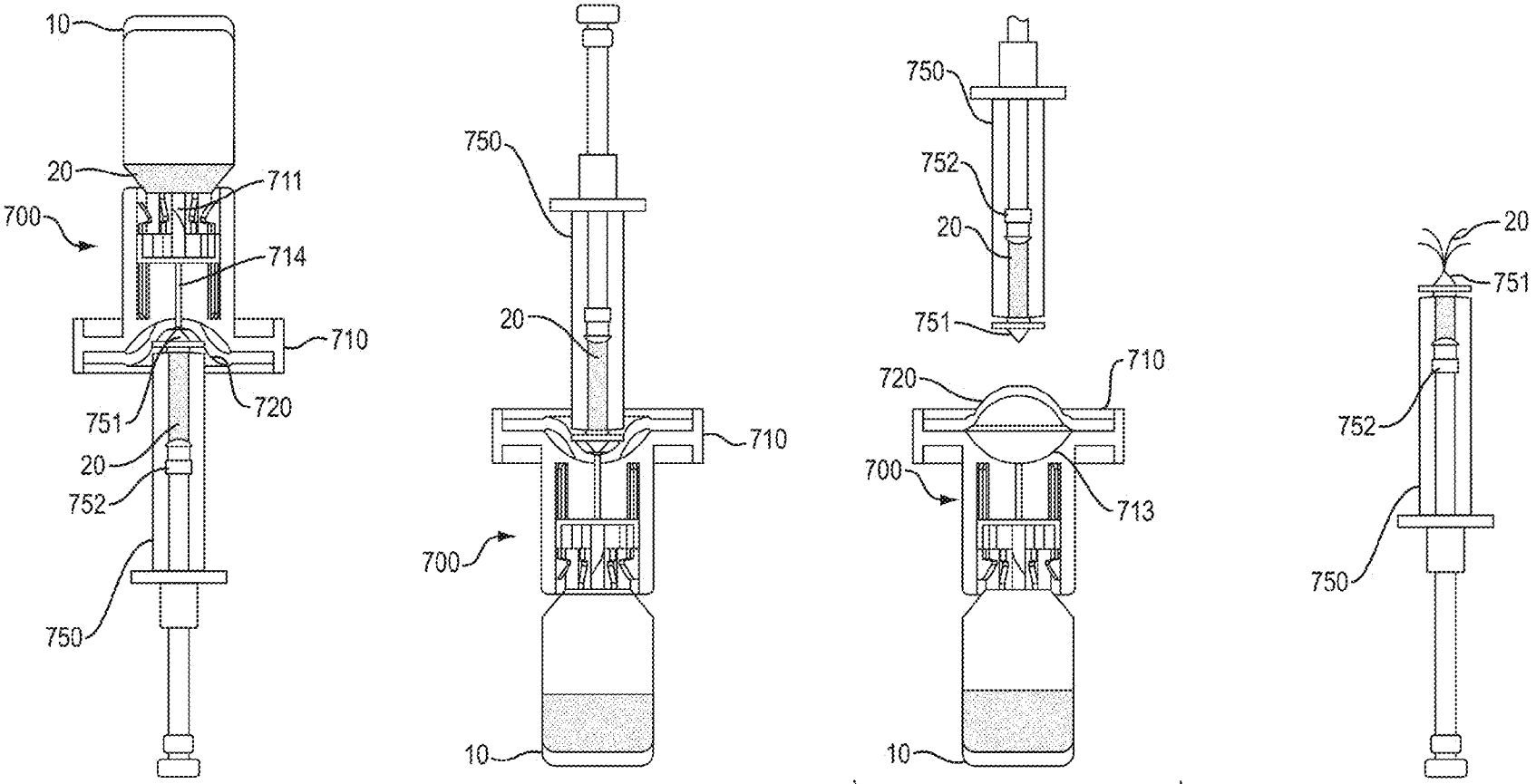

In FIG. 7D, the plunger 752 presses the air 30 from the ampoule 720, through the opened pinhole orifice 721, through the orifice 714 in the body 710 of the adaptor 700, through the cannula 711 and finally into the vial 10, increasing the pressure in the vial. Increasing the pressure in the vial 10 prevents the plunger 752 from otherwise lowering the vial 10 pressure below the ambient pressure during withdrawal of the fluid 20, which would resist the movement of the fluid 20 and the plunger 752. In FIG. 7E, the plunger 752 is withdrawn from the nozzle and withdraws the liquid 20 from the vial 10 through the cannula 711, orifice 714, and opened pinhole orifice 721. The plunger's 752 withdrawal motion is assisted by the higher pressure in the vial 10. In FIG. 7F, the vial 10, adapter 700, and ampoule 750 are turned upright. In FIG. 7G, the nozzle 751 is removed from the hemispherical membrane 720. As the nozzle 751 is removed, the hemispherical membrane 720 returns to a stable convex position (shown in FIG. 7A), closing the pinhole orifice (not shown) and does not draw any liquid 20 into the cannula 711. In FIG. 7H, to remove any dead volume in the ampoule 750, the plunger 752 is pushed forward slightly until the liquid 20 is ejected from the nozzle 751. Automated methods for simultaneous bubble detection and expulsion are disclosed in U.S. Provisional Application 61/898,516, filed on Nov. 11, 2013, and can be incorporated into the operation of FIG. 7H to reduce bubbles in the ampoule while moving the plunger 752 forward.

Figure 8A:
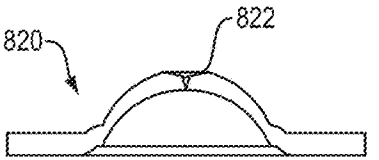
FIGS. 8A-F are schematics and images of how a pinhole orifice and dimple change as the hemispherical membrane is inverted.
Figure 8B:
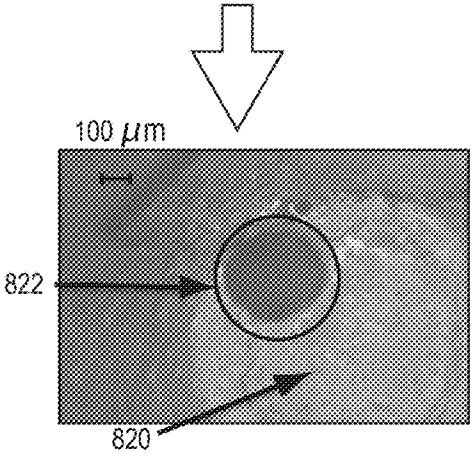
Figure 8C:
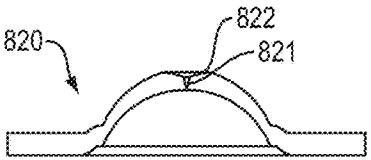
Figure 8D:
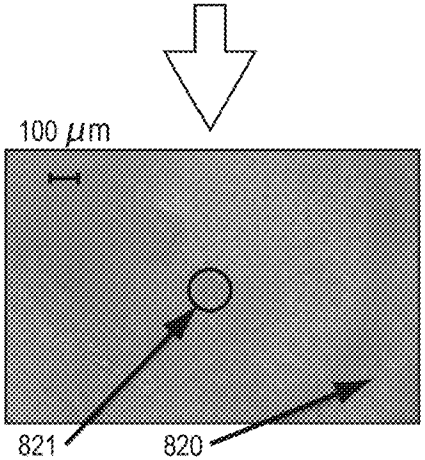
Figure 8E:
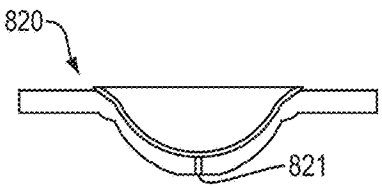
Figure 8F:
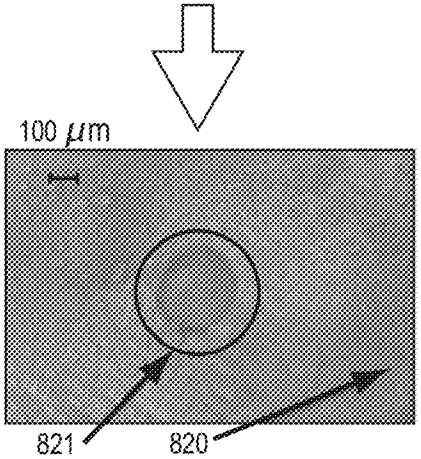

FIGS. 8A, 8C, and 8E are schematics of a polyurethane hemispherical membrane 820 having a pinhole 821 and dimple 822. FIGS. 8B, 8D, and 8E are 6.6× magnification images of sample polyurethane membranes 820 showing the dimple (FIG. 8B), a closed pinhole orifice (FIG. 8D), and an opened pinhole orifice (FIG. 8F). While the membrane shown in the FIGS. 8B, 8D, and 8E is made of polyurethane, other materials such as halobutyl or ethylene propylene diene monomer can also be used. FIG. 8A is a schematic of a polyurethane membrane 820 in a stable convex shape. The exterior surface of the polyurethane membrane 820 includes a center pinhole orifice 821 and a dimple 822.

FIG. 8B a magnified image of the external surface of a polyurethane membrane 820 in the stable convex position showing the dimple 822 around the pinhole orifice (not visible), as illustrated in corresponding FIG. 8A.

FIG. 8C is a schematic of a polyurethane membrane 820 in a stable convex shape, including a center pinhole orifice 821 and concave dimple 822 on the exterior surface of the polyurethane membrane 820. FIG. 8D is a magnified image of the internal surface of a polyurethane membrane 820 in the stable convex position showing the closed pinhole orifice 821, as illustrated in corresponding FIG. 8C.

FIG. 8E is a schematic of a polyurethane membrane 820 in an inverted position showing an open pinhole orifice 821, the dimple (822 in FIGS. 8A and 8C) having formed an exterior portion of the open pinhole orifice 821. FIG. 8F is an image of the inner surface of a polyurethane membrane 820 and open pinhole orifice 821 in the inverted position, as illustrated in corresponding FIG. 8E.

FIG. 8B shows that, in the stable convex position, as illustrated in corresponding FIGS. 8A and 8C, the polyurethane membrane 820 has a concave dimple 822 on the exterior surface of the polyurethane membrane 820, but a small-to-nonexistent pinhole orifice 821 opening on the bottom side, as shown in FIG. 8D. No fluid can pass through the pinhole orifice 821. When the polyurethane membrane 820 is inverted, the closed pinhole orifice 821 on the internal surface stretches to a significantly large diameter to enable liquid to be drawn from the vial or cartridge into the ampoule. While the images of FIGS. 8B, 8D, and 8F are of a polyurethane material, it should be noted that the same process would be seen in other elastomers as well.

While this invention has been particularly shown and described with references to example embodiments thereof, it will be understood by those skilled in the art that various changes in form and details may be made therein without departing from the scope of the invention encompassed by the appended claims.

What is claimed is:

1. A needle-free adaptor for removing liquid from a vial, the needle-free adaptor comprising:

a cannula having a distal end adapted to pierce a septum of a vial;

a securing mechanism surrounding the cannula, the securing mechanism configured to secure the adaptor to the vial when the cannula has pierced the septum;

a membrane comprising a normally closed orifice, the membrane having a stable convex position and an inverted position, the membrane adapted to receive a nozzle of a needle-free device and buckle from the stable position to the inverted position;

a curved conforming surface facing the membrane and adapted to receive the membrane when the membrane is buckled by the nozzle, the conforming surfacing including an orifice connected to the cannula; and when the membrane buckles to the inverted position, the normally closed orifice opens and interfaces with the orifice on the conforming surface, enabling fluid communication between the vial and the nozzle with the membrane in the inverted position pressed by the nozzle against the conforming surface to sealingly connect the nozzle to the cannula.

2. The needle-free adaptor of claim 1, wherein the membrane is an elastomeric membrane.

3. The needle-free adaptor of any claim 2, wherein the securing mechanism is a plurality of legs, and further comprising a protective cover surrounding the plurality of legs, the protective cover extending beyond the distal end of the cannula.

4. The needle-free adaptor of claim 1, further comprising a removable cap covering the elastomeric membrane over the orifice.

5. The needle-free adaptor of claim 2, further comprising a sleeve adjacent to and extending beyond a convex external surface of the elastomeric membrane, the sleeve adapted to protect the external surface of the elastomeric membrane and prevent unintended inversion with buckling of the elastomeric membrane.

6. The needle-free adaptor of claim 5, wherein the sleeve is adapted to have a friction fit against an ampoule of the needle-free device when the nozzle contacts the elastomeric membrane.

7. The needle-free adaptor of claim 5, wherein the sleeve includes one or more locking features to secure an ampoule of the needle-free device to the adaptor.

8. The needle-free adaptor of claim 7, wherein the one or more locking features is selected from the group comprising: snap fittings, a luer lock, and screw threads.

9. The needle-free adaptor of any of claim 2, wherein the elastomeric membrane comprises polyurethane.

10. The needle-free adaptor of claim 2, wherein the elastomeric membrane comprises ethylene propylene diene monomer (EPDM).

11. The needle-free adaptor of claim 2, wherein the elastomeric membrane comprises halobutyl.

12. The needle-free adaptor of claim 2, wherein the elastomeric membrane has a hemispherical shape and the stable position is a stable convex position.

13. The needle-free adaptor of claim 2, wherein the normally closed orifice includes a dimple in an external surface of the elastomeric membrane, the dimple forming a hole in the elastomeric membrane when the elastomeric membrane is buckled to the inverted position.

14. The needle-free adaptor of claim 2, wherein buckling of the elastomeric membrane requires a buckling pressure and the inverted position is maintained by a holding pressure, the holding pressure being less than the buckling pressure.

15. The needle-free adaptor of claim 2, wherein the elastomeric membrane is a bi-stable membrane having a stable position and pseudostable inverted position, the pseudostable inverted position returning to the stable position after removal of the ampoule.

16. The needle-free adaptor of claim 15, wherein the elastomeric membrane includes a hemispherical region adjacent to the conforming surface, a peripheral region attached to the body of the adaptor, and a thin ridge joining the hemispherical region to the peripheral region, the thin ridge configured to provide a pseudostable boundary condition for the hemispherical region.

17. The needle-free adaptor of claim 2, wherein the elastomeric membrane is a mono-stable membrane having a stable position and an unstable inverted position, the unstable inverted position returning to the stable position immediately after removal of the ampoule.

18. The needle-free adaptor of claim 1, wherein the normally closed orifice is a pinhole or slit orifice.

19. A method of drawing a substance from a vial without a needle, the method comprising:

piercing a septum of a vial with a cannula of an adaptor;

securing the adaptor to the vial with a securing mechanism;

deflecting a membrane of the adaptor from a stable convex position to an inverted position with a nozzle of a needle-free device, the deflecting opening an orifice in the membrane;

with the nozzle, pressing the deflected membrane against a curved conforming surface of the adaptor facing the membrane, the conforming surface having an orifice in fluid communication with the cannula, the pressing creating an interface between the opened orifice in the membrane and the orifice of the conforming surface to sealingly connect the nozzle to the cannula;

drawing a substance from the vial, through the orifice of the conforming surface, the opened orifice in the membrane, and the nozzle; and removing the nozzle from the membrane, the membrane returning to the stable convex position and closing the pinhole orifice.

20. The method of claim 19, wherein the membrane is an elastomeric membrane.

21. The method of claim 19, further including:

prior to drawing the substance from the vial, inverting the adaptor and nozzle; and after drawing the substance from the vial, returning the adaptor to an upright position and removing the nozzle from the membrane.

22. The method of claim 21, further including, prior to drawing the substance from the vial, pushing a volume of air into the vial.

23. The method of claim 19, further including:

surrounding the securing mechanism with a protective sleeve.

24. The method of claim 19, further including:

prior to drawing the substance from the vial, forcing a liquid through the nozzle, the opened orifice in the membrane, and the orifice of the conforming surface and into the vial, the liquid reconstituting the substance in the vial.

* * * * *